US005312500A

United States Patent [19]

Kurihara et al.

[11] Patent Number: 5,312,500

[45] Date of Patent: May 17, 1994

[54] NON-WOVEN FABRIC AND METHOD AND APPARATUS FOR MAKING THE SAME

[75] Inventors: Kazuhiko Kurihara; Shigezou Kojima, both of Tokyo; Hiroshi Yazawa, Kunitachi; Toshikazu Oishi, Kawaguchi, all of Japan

[73] Assignees: Nippon Petrochemicals Co., Ltd.; Polymer Processing Research Inst., Ltd., both of Tokyo, Japan

[21] Appl. No.: 613,542

[22] PCT Filed: Mar. 12, 1990

[86] PCT No.: PCT/JP90/00318

§ 371 Date: Dec. 4, 1990

§ 102(e) Date: Dec. 4, 1990

[87] PCT Pub. No.: WO90/10743

PCT Pub. Date: Sep. 20, 1990

Related U.S. Application Data

[63] Continuation-in-part of Ser. No. 302,627, Feb. 21, 1989, Pat. No. 4,992,124.

[30] Foreign Application Priority Data

Mar. 10, 1989 [JP] Japan ..... 1-58384

[51] Int. Cl.[5] ..... B32B 31/00

[52] U.S. Cl. ..... 156/62.4; 156/62.8; 156/73.6; 156/167; 156/181

[58] Field of Search ..... 428/196, 198, 286, 287, 428/288, 296; 156/62.4, 62.8, 73.6, 167, 181

[56] References Cited

U.S. PATENT DOCUMENTS

| | | | |
|---|---|---|---|
| 2,574,221 | 11/1951 | Modigliana | 156/167 |
| 2,982,310 | 5/1961 | West | 156/242 |
| 3,616,037 | 10/1971 | Burger | 156/177 |
| 3,682,734 | 8/1972 | Burger | 156/166 |
| 4,185,981 | 1/1980 | Ohsato | 65/5 |

FOREIGN PATENT DOCUMENTS

| | | | |
|---|---|---|---|
| 2302928 | 7/1974 | Fed. Rep. of Germany | 428/296 |
| 2112416 | 6/1972 | France . | |
| 2217459 | 9/1974 | France | 428/296 |
| 1219921 | 1/1971 | United Kingdom . | |

*Primary Examiner*—Jenna L. Davis

*Attorney, Agent, or Firm*—Bucknam and Archer

[57] ABSTRACT

A non-woven fabric is characterized by including a filament layer in which one or more continuous filaments composed of a polymeric material are spirally collected substantially along a shape obtained by offsetting an ellipse having an elongated major axis in a plane. This non-woven fabric can be obtained by spinning a filament composed of a polymeric material, vibrating the filament, amplifying vibration of the filament, and collecting the filament into an elliptic shape having an elongated major axis so that the filament is arranged in a direction of the major axis.

17 Claims, 12 Drawing Sheets

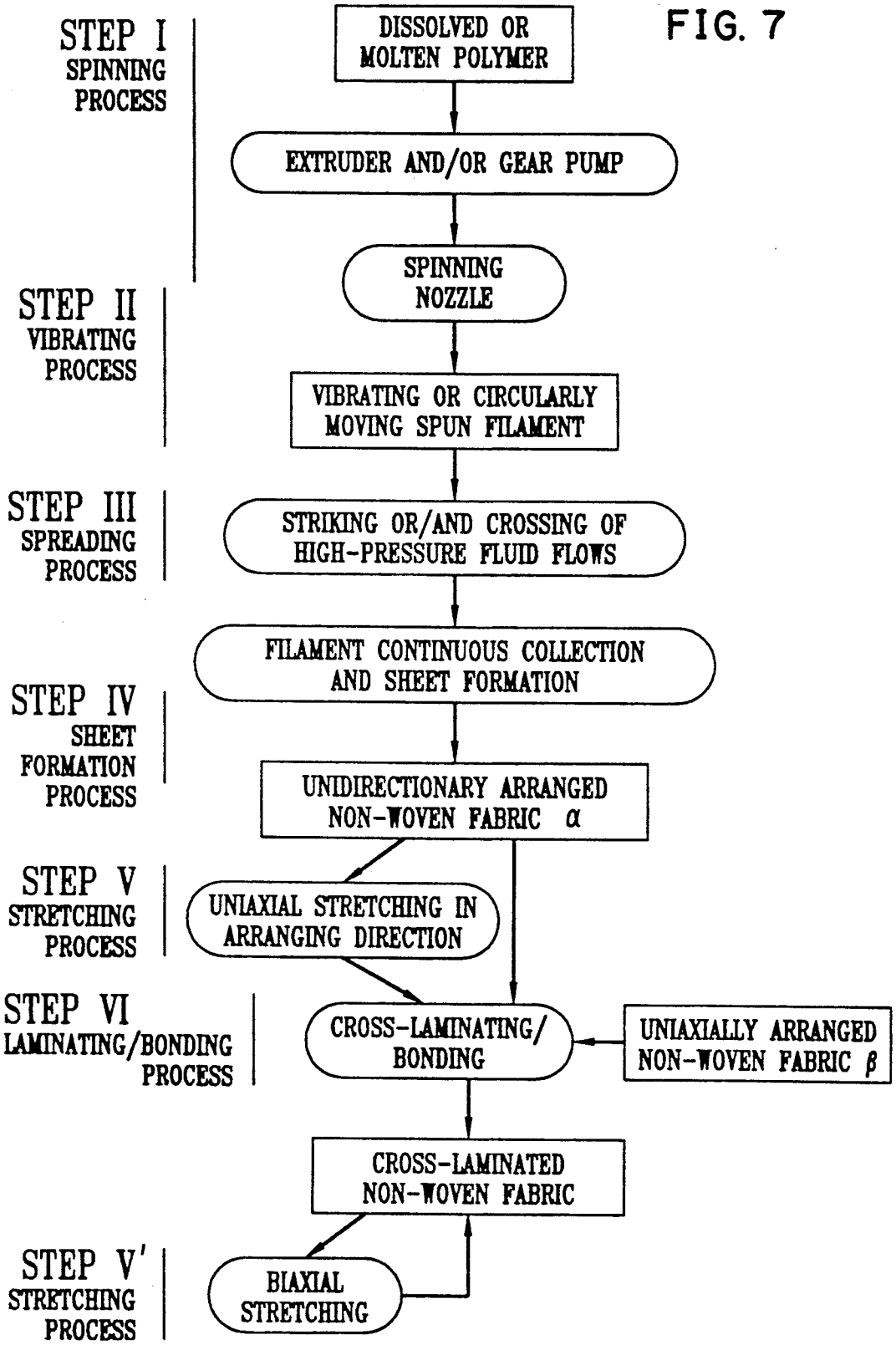
FIG. 7
STEP I
SPINNING PROCESS
DISSOLVED OR MOLTEN POLYMER
EXTRUDER AND/OR GEAR PUMP
SPINNING NOZZLE
STEP II
VIBRATING PROCESS
VIBRATING OR CIRCULARLY MOVING SPUN FILAMENT
STEP III
SPREADING PROCESS
STRIKING OR/AND CROSSING OF HIGH-PRESSURE FLUID FLOWS
FILAMENT CONTINUOUS COLLECTION AND SHEET FORMATION
STEP IV
SHEET FORMATION PROCESS
UNIDIRECTIONARY ARRANGED NON-WOVEN FABRIC α
STEP V
STRETCHING PROCESS
UNIAXIAL STRETCHING IN ARRANGING DIRECTION
STEP VI
LAMINATING/BONDING PROCESS
CROSS-LAMINATING/ BONDING
UNIAXIALLY ARRANGED NON-WOVEN FABRIC β
CROSS-LAMINATED NON-WOVEN FABRIC
STEP V'
STRETCHING PROCESS
BIAXIAL STRETCHING FIG. 8
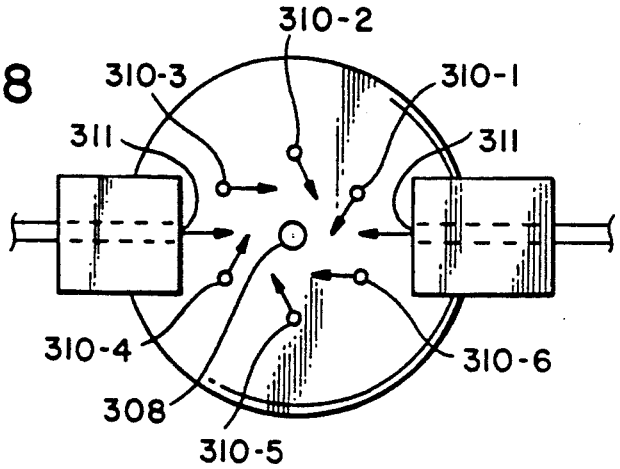
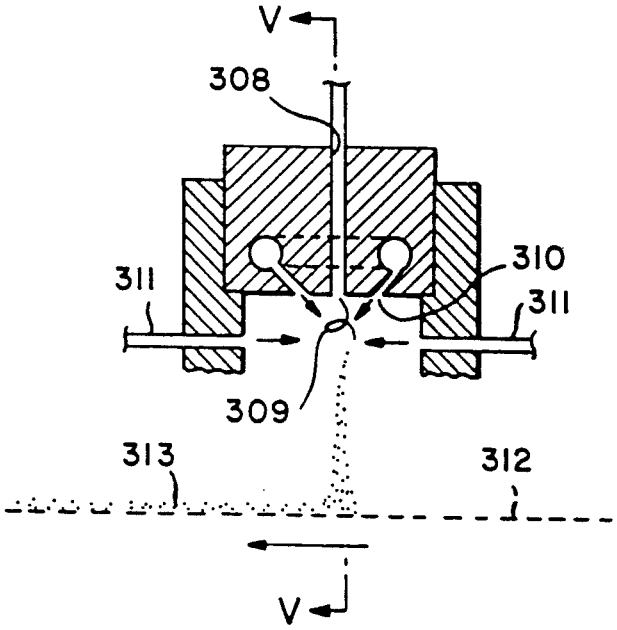
FIG. 9
FIG. 10
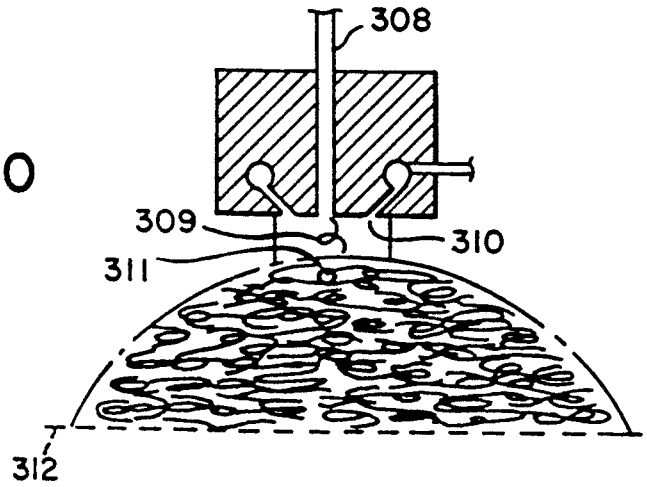

NON-WOVEN FABRIC AND METHOD AND APPARATUS FOR MAKING THE SAME

This is a continuation-in-part of Ser. No. 302,627 filed Feb. 21, 1989, now U.S. Pat. No. 4,992,124.

TECHNICAL FIELD

The present invention relates to a non-woven fabric obtained by spinning a polymeric material and a method and apparatus for making the same and, more particularly, to a non-woven fabric in which filaments composing the non-woven fabric are collected to form an ellipse having an elongated major axis and the filaments are arranged in substantially the major axis direction and a method and apparatus for making the same.

BACKGROUND ART

Random-laid non-woven fabrics made by a conventional spun bonding method and the like are excellent in bulkiness and texture. The random-laid non-woven fabrics also have excellent water permeability and filtering characteristics. Since, however, filaments are arranged substantially at random in the random-laid non-woven fabrics, the random-laid non-woven fabrics have only a poor dimensional stability and a small strength in the longitudinal and transverse directions. In order to improve the strength, the conventional random-laid non-woven fabrics may be stretched. When the conventional random-laid non-woven fabrics are simply stretched in the longitudinal or transverse direction, however, an interengagement or bondage connecting the filaments is often disconnected, and the filaments themselves are not stretched. Therefore, the strength of the non-woven fabrics is not increased.

In addition, a technique of biaxially stretching normal non-woven fabrics is available as disclosed in British Patent No. 1,213,441. When normal non-woven fabrics are biaxially stretched, however, the efficiency of stretching filaments composing the non-woven fabrics is low. Therefore, the strength of the non-woven fabrics cannot be sufficiently increased.

The present inventors, therefore, proposed a method and apparatus for stretching a non-woven fabric in the longitudinal or transverse direction, a means of cross-laminating a longitudinally stretched non-woven fabric and a transversely stretched non-woven fabric, a means of unidirectionally arranging spun filaments, and the like in Japanese Patent Application No. Sho 62-173927. The invention of this prior application is characterized in that a long-fiber random-laid non-woven fabric obtained by spinning un-oriented filaments is stretched in a predetermined direction so that the filaments composing the non-woven fabric are substantially stretched to cause a molecular orientation. As disclosed in this prior application, when a non-woven fabric in which filaments are unidirectionally arranged is stretched in an arranging direction of the filaments, the filaments are stretched, and the strength of the non-woven fabric is increased. In accordance with the type of filaments composing a non-woven fabric, if only the filaments are arranged, a satisfactory strength or dimensional stability can be obtained in the arranging direction of the filaments without stretching the fabric.

The method of making a sheet by shaking fibers is disclosed in Japanese Patent Publication No. Sho 45-10779. In this method, a fluid is alternately, intermittently sprayed from right and left directions to a portion close to a jet outlet of fibers, thereby shaking the fibers to make a sheet.

DISCLOSURE OF INVENTION

It is an object of the present invention to provide a non-woven fabric having a good dimensional stability and a large strength in both the longitudinal and transverse directions and a method and apparatus for making the same.

A non-woven fabric according to the present invention includes a filament-laid layer in which one or more continuous filaments obtained by spinning a polymeric material are collected to form an ellipse having an elongated major axis and the filaments are arranged in a substantially major axis direction. That is, one or more continuous filaments are spirally collected along a shape in which an ellipse having an elongated major axis is gradually shifted in a plane. Since one or more continuous filaments are substantially unidirectionally arranged, the strength in the arranging direction is larger than those of conventional random-laid non-woven fabrics.

The above filament-laid layer is preferably stretched in an arranging direction of the filaments. The strength of the non-woven fabric is further increased by stretching.

The method and apparatus for making the non-woven fabric according to the present invention is characterized in that filaments consisting of a polymeric material spun from a spinning nozzle are vibrated, the vibration of the filaments are amplified to collect the filaments into an ellipse having an elongated major axis, and the filaments are scattered and spread so as to be arranged in a substantially major axis direction. That is, the method of making the non-woven fabric according to the present invention comprises the steps of spinning filaments consisting of a polymeric material, vibrating the filaments, amplifying the vibration of the filaments, and collecting the filaments to form an ellipse having an elongated major axis so that the filaments are arranged in a substantially major axis direction. The apparatus of making the non-woven fabric according to the present invention comprises means for spinning filaments consisting of a polymeric material, means for vibrating the filaments, means for amplifying the vibration of the filament, stage means for arranging the filaments on a plane to form a sheet, and means for moving the filament spinning means and the stage means relative to each other.

Examples of the polymeric material are a polymeric material dissolved or dispersed in the form of an emulsion in a solvent and a melted polymeric material.

Filaments are preferably vibrated spirally or in zigzag.

The vibration of filaments is preferably performed as described in the following items (1 ), (2), and (3).

(1) A small amount of fluid is applied at a small pressure from a portion close to a spinning nozzle immediately after filaments are spun, thereby vibrating the filaments.

(2) An electric charge is applied to filaments to apply an electric or magnetic field having an alternately changing polarity, thereby vibrating the filaments.

(3) A spinning nozzle is vibrated by a circular motion or reciprocation, thereby vibrating filaments.

Filaments are preferably spread while vibrating filaments have draft properties of twice or more. Normally, draft properties (draft ratio) in spinning is represented by:

(take-up rate)/(injection rate at spinning nozzle) In this case, filaments injected from a spinning nozzle are elongated in vibrating and spreading steps, and this elongation ratio is defined as the draft properties.

Spreading of filaments is preferably performed such that a pair or more of fluid flows which are substantially symmetrical about filaments are continuously supplied sideways on the filaments, thereby scattering and spreading the filaments to be unidirectionally arranged. In particular, the fluid flows are preferably continuously struck on the filaments to scatter the filaments in a direction perpendicular to a jet direction of the fluid flows. Alternatively, the fluid flows are continuously crossed (staggered) within a vibration range of the filaments to scatter the filaments in a direction parallel to the jet direction of the fluid flows.

If the filaments are stretched in the arranging direction after they are unidirectionally arranged, the strength of the non-woven fabric is further enhanced.

When a non-woven fabric according to the present invention is laminated on another base material or another non-woven fabric, a non-woven fabric having a large strength can be obtained. Especially when a non-woven fabric in which filaments are arranged in a first direction and a non-woven fabric in which filaments are arranged in a second direction substantially perpendicular to the first direction are laminated, the strength of the non-woven fabric is further increased.

According to the method and apparatus of the present invention, a one-way-oriented non-woven fabric which conventionally has a very narrow stability range can be stably made to have a good one-way orientation regardless of the type of polymer. In addition, the method and apparatus of the present invention can be applied to any of a wet-spinning process, a dry-spinning process, and an emulsion-spinning process. According to the present invention, any spun filaments can be stably turned or vibrated and scattered to be unidirectionally arranged with a good orientation. Therefore, filaments arranged in the longitudinal or transverse direction can be easily made in any of the wet-, dry-, and emulsion-spinning processes. The obtained fibers can be united with a cross-arranged non-woven fabric to make a non-woven fabric having a high dimensional stability in both the longitudinal and transverse directions. In addition, even a molten polymer having a high viscosity can be formed into filaments unidirectionally arranged well. This polymer is most suitably used in making of a non-woven fabric which is stretched in an arraigning direction of filaments to gain a large strength.

BRIEF DESCRIPTION OF DRAWINGS

FIG. 7 is a flow diagram showing individual steps according to an embodiment of the method of making a non-woven fabric according to the present invention;

FIG. 8 is a bottom view showing a practical arrangement of a spinning nozzle for forming filaments to be arranged in the transverse direction of a non-woven fabric;

FIG. 9 is a schematic side sectional view showing an apparatus, having the spinning nozzle shown in FIG. 8, for making a non-woven fabric having filaments arranged in the transverse direction;

FIG. 10 is a sectional view taken along a line V—V in FIG. 9;

BEST MODE FOR CARRYING OUT THE INVENTION

The present invention will be described in detail below with reference to the accompanying drawings.

Figure 1A:
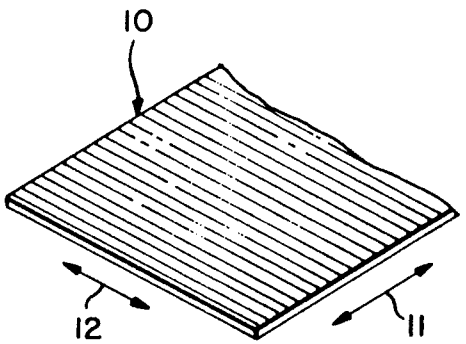
FIGS. 1A to 1C are schematic perspective views showing outer appearances of non-woven fabrics according to the present invention, in which filaments are arranged in a transverse direction (widthwise direction of a non-woven fabric)

FIG. 1A is a schematic perspective view showing the outer appearance of a non-woven fabric (unidirectional non-woven fabric) 10 according to the present invention in which filaments are arranged in the transverse direction. Referring to FIG. 1A, the direction indicated by arrow 11 indicates the longitudinal direction, and the direction indicated by arrow 12 indicates the transverse direction. The direction indicated by hatching indicates the arranging direction of the filaments. Note that in FIGS. 1B and 1C, 2A to 2C, and 3A to 3C, the arrows 11 and 12 and hatching have the same meanings as in FIG. 1A.

Figure 1B:
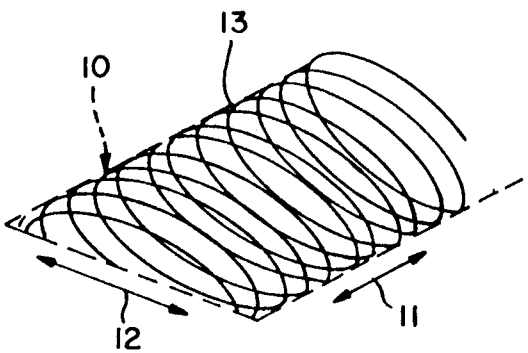

FIG. 1B shows a filament 13 by reducing the density of an arrangement in order to explain the filament arrangement shown in FIG. 1A. As shown in FIGS. 1B, the filament is collected to form an ellipse having a very long major axis. As a result, the filament is arranged in a major axis direction (transverse direction). Actually, the filament 13 is arranged more densely. The filament 13 may be a plurality of filaments (as shown in, e.g., FIGS. 11B, 11C, and 11D) which are spun from a plurality of spinning nozzles of a single nozzle and vibrated and spread by a single nozzle vibrating/spreading apparatus. For illustrative simplicity, however, only one filament is shown in FIG. 1B. In addition, although the filament is regularly arranged in FIG. 1B, it is sometimes scattered more irregularly. This is the same in FIGS. 2B and 3B.

The unidirectional non-woven fabric 10 shown in FIGS. 1A and 1B has a filament-laid layer in which one continuous filament (or a plurality of filaments) 13 obtained by spinning a polymeric material is arranged in substantially the transverse direction.

Figure 1C:
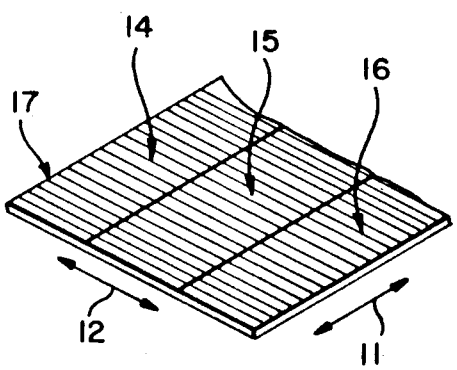

FIG. 1C shows a unidirectional non-woven fabric 17 in which three arrays 14 to 16 in each of which a filament is arranged in the transverse direction are arranged in parallel with each other.

Figure 2A:
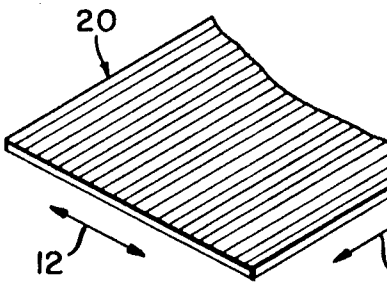
FIGS. 2A to 2C are schematic perspective views showing outer appearances of non-woven fabrics according to the present invention, in which filaments are arranged in a longitudinal direction (lengthwise direction of a non-woven fabric)

FIG. 2A is a schematic perspective view showing a unidirectional non-woven fabric 20 according to the present invention in which a filament is arranged in the longitudinal direction.

Figure 2B:
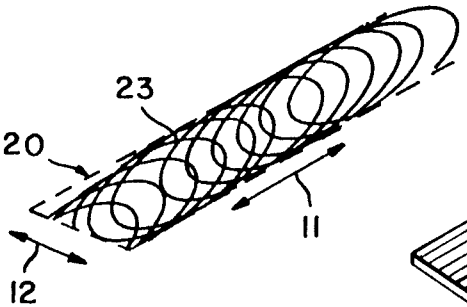

FIG. 2B shows a filament 23 by reducing the density of an arrangement in order to explain the filament arrangement shown in FIG. 2A. Actually, the filament 23 is arranged more densely. The unidirectional non-woven fabric shown in FIGS. 2A and 2B has a filament-laid layer in which one continuous filament (or a plurality of filaments) 23 obtained by spinning a polymeric material is arranged in substantially the longitudinal direction.

Figure 2C:
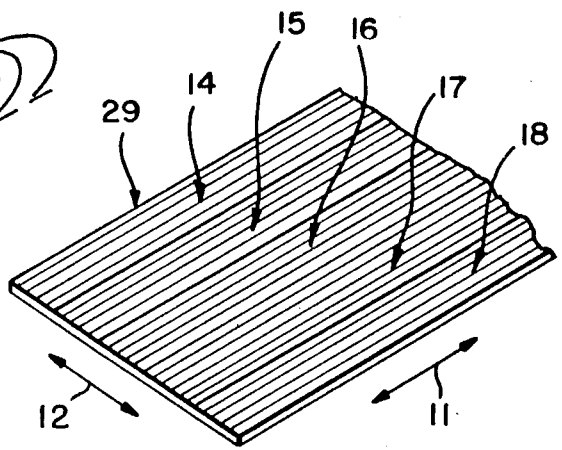

FIG. 2C shows a unidirectional non-woven fabric 29 in which five arrays 24 to 28 in each of which a filament is arranged in the longitudinal direction are arranged in parallel with each other.

Figure 3C:
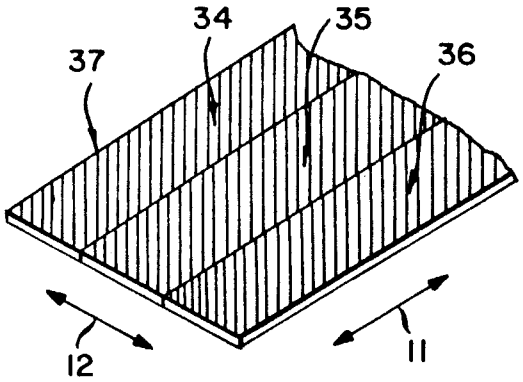
FIGS. 3A to 3C are schematic perspective views showing outer appearances of non-woven fabrics according to the present invention, in which filaments are obliquely arranged.
Figure 3B:
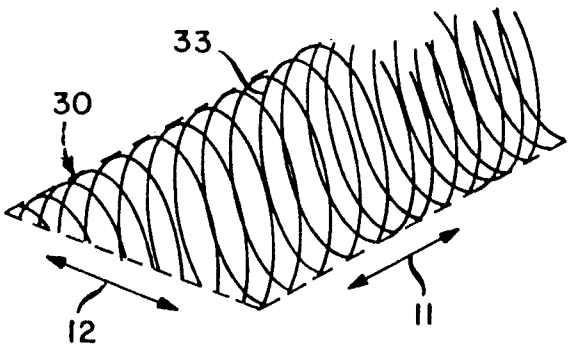
Figure 3A:
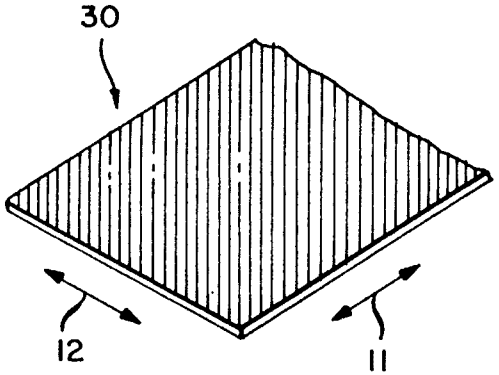

FIG. 3A is a schematic perspective view showing a unidirectional non-woven fabric 30 according to the present invention in which a filament is obliquely arranged.

FIG. 3B shows a filament 33 by reducing the density of an arrangement in order to explain the filament arrangement shown in FIG. 3A. Actually, the filament 33 is arranged more densely. The unidirectional non-woven fabric 30 shown in FIGS. 3A and 3B has filament-laid layer in which one continuous filament (or a plurality of filaments) 33 obtained by spinning a polymeric material is substantially obliquely arranged.

FIG. 3C shows a unidirectional non-woven fabric 37 in which three arrays 34 to 36 in each of which a filament is obliquely arranged are arranged in parallel with each other.

In each of the unidirectional non-woven fabrics shown in FIGS. 1A to 3C, one or more continuous filaments are substantially unidirectionally arranged. Therefore, the strength in the arranging direction is larger than those of conventional non-woven fabrics.

Figure 4:
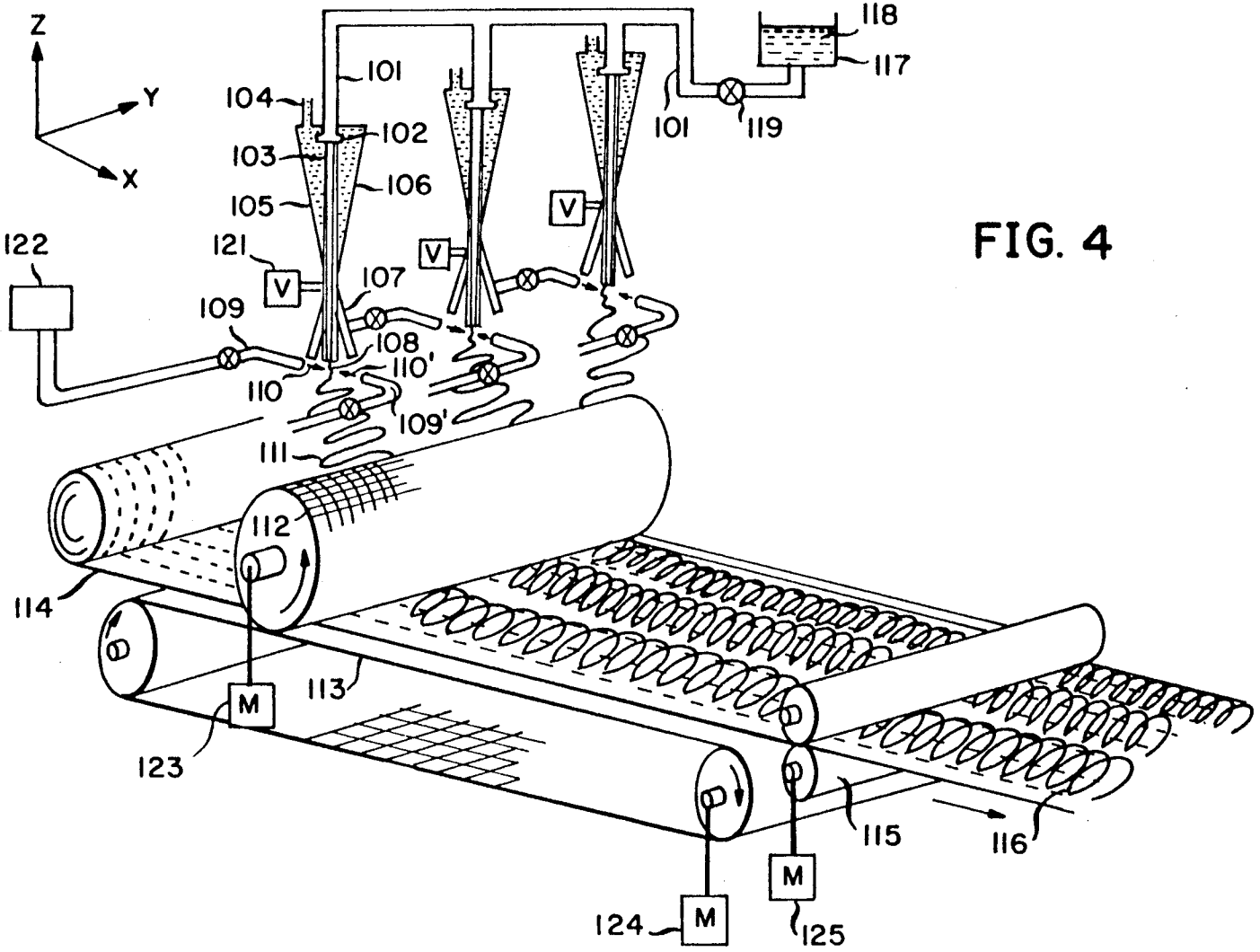
FIG. 4 is a schematic perspective view showing an example of making a non-woven fabric according to the present invention.

FIG. 4 shows an example of making a non-woven fabric according to the present invention.

Spinning of filaments will be described first. A fiber-forming polymer 118 is dissolved in a solvent in a dissolving pot 117. This polymer 118 is supplied to each nozzle 102 through a conduit 101 at a predetermined pressure by a gear pump 119. The nozzle 102 has a large number of spinning nozzles. The polymer 118 is extruded as a multifilament from the nozzle 102. An extruded filament 103 is spun into a coagulating solution 106 supplied from a corresponding inlet port 104 into a corresponding funnel-shaped coagulating bath 105.

The mechanism for vibrating a filament will be described below. A root 107 as a lower linear portion of each funnel 107 is flexible. This linear portion 107 is vibrated by a vibrator 121 (V) in the transverse direction. In FIG. 4, the X, Y, and Z axes are set such that the line (longitudinal) direction corresponds to the X axis, the transverse direction corresponds to the Y axis, and the vertical direction corresponds to the Z axis. Upon vibration of the linear portion 107, the spun multifilament 108 is vibrated in zigzag in the Y direction.

The mechanism for amplifying the vibration of a filament will be described. High-pressure fluid flows 110 and 110' are applied on the multifilament 108 vibrated in zigzag. The high-pressure fluid flows 110 and 110' are supplied from a fluid supply device 122. Although similar fluid flows are supplied to other conduits, they are not shown for illustrative simplicity. The high-pressure fluid flows 110 and 110' are jetted from conduits 109 and 109' in opposite directions along the X axis. The high-pressure fluid flows 110 and 110' are jetted toward the center of the width of a zigzag formed by the zigzagging filament 108. The high-pressure fluid flows 110 and 110' strike against each other at the center of the width of the zigzag of the filament 108. The fluid flows 110 and 110' may be a coagulating solution 106 or another type of coagulating solution. Alternatively, the fluid flows 110 and 110' may be high-pressure air streams.

By the impact of the struck fluid flows 110 and 110', the zigzag width is increased in the Y direction to form the filament into a filament group 111, and the filament group 111 is collected on a net 112.

FIG. 4 shows two more sets of devices for vibrating a spun filament in zigzag in the transverse direction. Although a larger number of sets are installed in both the transverse direction (Y direction) and the longitudinal direction (machine direction, i.e., the X direction) in an actual apparatus, they are omitted from FIG. 4 for illustrative simplicity.

The step of arranging a filament will be described below.

The net 112 is formed cylindrically and rotated by a driving means 123 (M). Most of the coagulating solution 106 and the fluid flows 110 and 110' are separated from the filament through the cylindrical net 112. A vacuum suction means may be disposed inside the cylindrical net 112 to improve separation of the coagulating solution.

An endless conveyor belt 113 is disposed in almost contact with the lower portion of the cylindrical net 112. The conveyor belt 113 is driven to be circulated by a driving means 124. A stage means for arranging a filament into a sheet is constituted by the cylindrical net 112, the conveyor belt 113, and the like. When the cylindrical net 112 and the conveyor belt 113 are driven the driving means 123 and 124, the stage means is moved relative to the mechanism for spinning a filament.

Reference numeral 114 denotes a web in which fibers are mainly arranged in the longitudinal direction and which has a strength in the longitudinal direction. The web 114 is guided into and conveyed by the conveyor belt 113. The web 114 is laminated with the collected filament group 111 under the cylindrical net 112. The laminated web is conveyed to a nip roll 115 and formed into a laminated non-woven fabric 116. Reference numeral 125 denotes a driving means for driving the nip roll 115.

Referring to FIG. 4, the web arranged in the transverse direction is roughly illustrated so that the arranging direction of the filaments is clearly shown. Actually, however, the filaments are arranged more densely.

The laminated non-woven fabric 116 has a filament layer which is spirally collected so that the filaments are arranged substantially along a shape in which an ellipse having an elongated major axis is gradually shifted in a plane.

Although the laminated non-woven fabric 16 can be directly used as a product, coagulation or scouring may be performed as needed. In addition, an adhesion or bonding treatment may be performed in order to strengthen adhesion between the fibers or webs before the non-woven fabric is used as a product.

Figure 5:
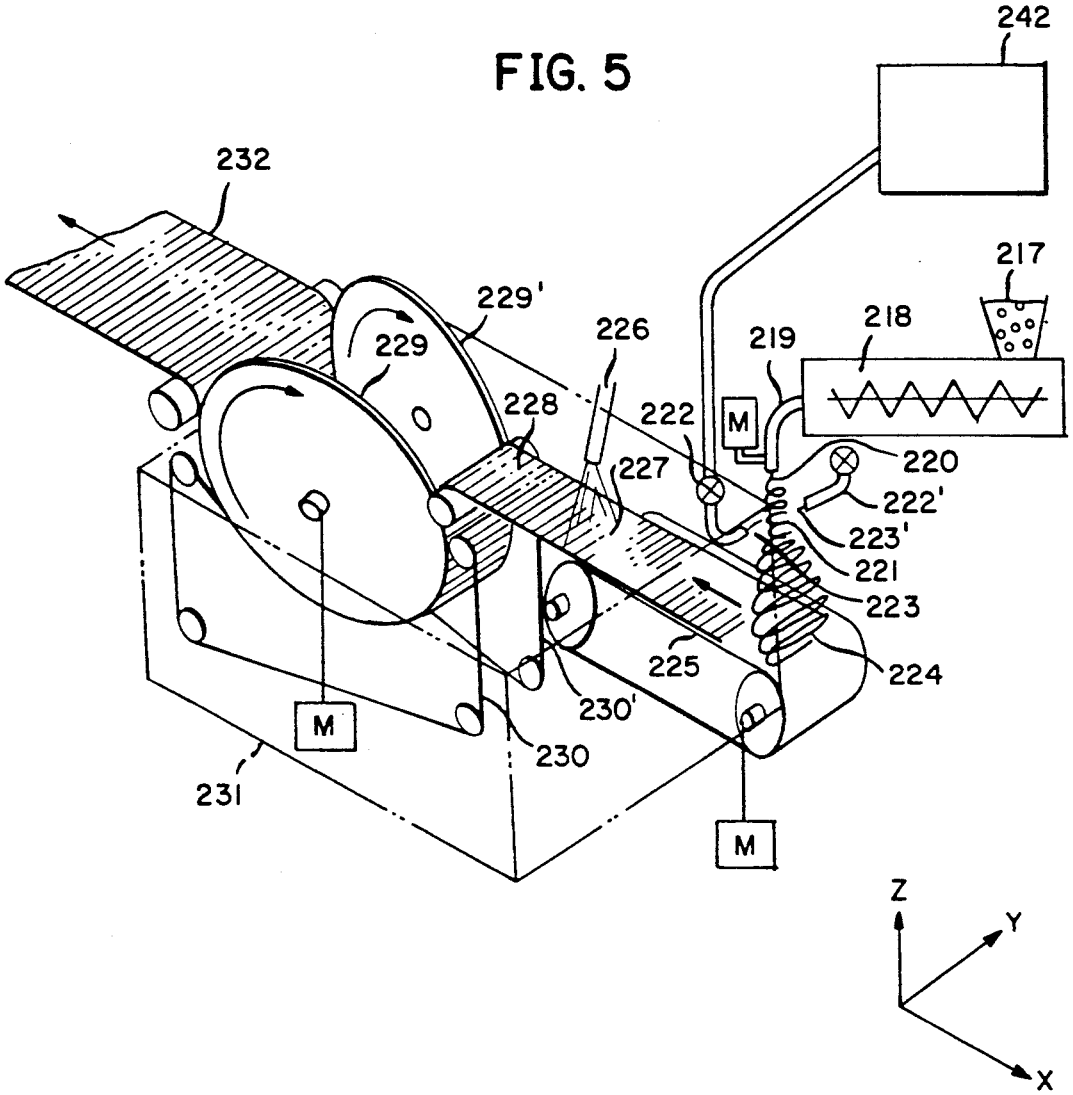
FIG. 5 is a schematic perspective view showing another example of making a non-woven fabric according to the present invention.

FIG. 5 shows another example of making non-woven fabric according to the present invention. Referring to FIG. 5, a polymer 217 is melted and kneaded by an extruder 218. The polymer 217 is guided to a spinning nozzle through a flexible conduit 219. The conduit 219 is circularly vibrated by a vibrating means 241 (V). Therefore, a spinning nozzle 220 is also circularly moved. By this circular motion of the spinning nozzle 220, a filament 221 spun from the spinning nozzle moves downward while it is spirally turned (vibrated).

A pair of high-pressure air streams 223 and 223' are jetted from pipes 222 and 222' in the Y direction of the x, Y, and Z axes shown in FIG. 5. The air is supplied from a supply means 242. The pair of high-pressure air streams 223 and 223' are jetted to cross (pass) each other at shifted intersections close to the central axis of the spiral orbit (as will be described in detail later with reference to FIG. 13B). The filament spirally moved downward is widened in the transverse direction (Y direction) by the crossed air steams. Therefore, the filament is collected on a conveyor belt 225 as a filament web 224 which is arranged in substantially the transverse direction.

The conveyor belt 225 is driven by a driving means 243 (M). The conveyor belt 225 conveys the transversely arranged web to an elongating means. A conduit 226 for jetting an adhesive 227 is disposed at a position shifted from the conveyor belt 225. The adhesive 227 is jetted to the transversely arranged web at this position. As a result, the bonding strength at bonded portions between fibers in the web is enhanced, and a web 228 is conveyed to an elongating step.

Two pulleys 229 and 229' are disposed to be widened toward the end in the stretching means. The pulleys 229 and 229' are driven by the driving means 244 (M). Two ends of the web 228 are held by the pulleys 229 and 229' and belts 230 and 230'. The web 228 is stretched in the transverse direction by the two pulleys 229 and 229' disposed to be widened toward the end. A heating medium (normally a hot wind) is filled in a stretching chamber 231. When the web 228 must be uniformly heated, the heating medium is sprayed through the web.

In this manner, a transversely stretched web 232 is made.

Although the transversely stretched web can be directly used as a product, it may be laminated and bonded to a longitudinally oriented web in another step to make a cross-laminated non-woven fabric having a strength in both the longitudinal and transverse directions.

Figure 6:
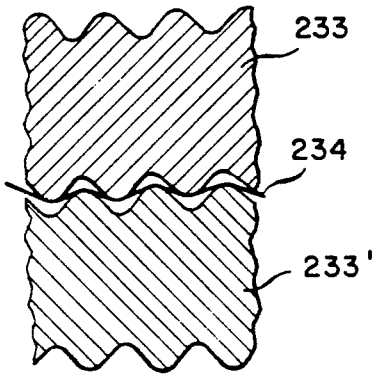
FIG. 6 is a sectional view showing a pair of grooved rolls of a non-woven fabric transverse-stretching apparatus.

FIG. 6 shows another example of a stretching means for stretching a web in the transverse direction. Referring to FIG. 6, a web 234 is stretched in the transverse direction between grooved rolls 233 and 233'. When such grooved rolls are to be used, a plurality of pairs of grooved rolls are preferably disposed.

Although a method of stretching a web in the transverse direction is shown in each of FIGS. 4 and 5, the spraying direction of the high-pressure air streams 223 and 223' may be changed through 90° to make a longitudinally arranged web. The strength of a longitudinally arranged web can be further increased by stretching the web between rolls or by a rolling means.

FIG. 7 is a flow diagram showing individual processes according to an embodiment of a method of making a non-woven fabric of the present invention. In FIG. 7, rectangle blocks denote materials, and elliptical blocks denote means or processing.

Referring to FIG. 7, step I is a spinning process. In the spinning process, a dissolved or melted polymer is supplied under pressure to a spinning nozzle by an extruder or a gear pump and spun into a filament by the spinning nozzle. In this process, any of a melt spinning process, a dry spinning process using a molten spun yarn and a solvent, a wet spinning process using a coagulating bath, and an emulsion spinning process as a special spinning method can be used.

Step II is a vibrating process of vibrating the spun filament in zigzag or spirally. In this process, the filament is vibrated by various types of methods to be described later with reference to FIG. 11. An amplitude of the vibration is several millimeters to several tens millimeters.

Step III is a spreading process of amplifying the vibration of the vibrated filament to spread the filament into a width of several hundred millimeters. As shown in FIG. 11A or 11B, spreading of a filament can be performed by a method of striking or crossing high-pressure fluid flows.

Step IV is a sheet formation process. In the sheet formation process, a filament spread in a predetermined direction by the spreading process is continuously collected to form a sheet. As a result, the filament is made into a unidirectional non-woven fabric $\alpha$. This unidirectional non-woven fabric $\alpha$ can be singly used as a product.

Step V is a stretching process. In the stretching process, the unidirectional non-woven fabric $\alpha$ is uniaxially stretched in the arranging direction. If the strength is insufficient by only spinning, a stronger product can be obtained via this stretching process.

Step VI is a laminating/bonding process. In the laminating/bonding process, the unidirectional non-woven fabric $\alpha$ and a unidirectional non-woven fabric $\beta$ having different arranging directions are cross-laminated/bonded. As a result, various types of cross-laminated non-woven fabric as shown in FIG. 14 to be described later. If the strength of a non-woven fabric is unsufficient by only spinning, a cross-laminated non-woven fabric having sufficient strength can be obtained by only laminating/bonding. If strength is insufficient by only spinning, the unidirectional non-woven fabric $\alpha$ and/or unidirectional non-woven fabric $\beta$ are stretched in step V and then laminated/bonded. As a result, a stronger product can be obtained.

Step V' is a biaxial stretching process. The biaxial stretching process is another method of performing stretching to obtain a strong non-woven fabric. In the biaxial stretching process, the unidirectional non-woven fabrics α and β are laminated/bonded and then biaxially stretched.

Formation of an un-oriented filament performed by an apparatus for vibrating a filament by a small amount of air will be described with reference to FIGS. 8 to 10.

A spinning apparatus comprises a nozzle plate or a spinneret having at its central portion a spinning nozzle 308 for extruding a polymeric material to be spun downward to form a filament 309, and a plurality of (six in FIGS. 8 to 10) oblique first air holes 310-1 to 310-6. The air holes 310-1 to 310-6 are disposed circumferentially around the spinning nozzle 308 at equal angular intervals to jet air against the filament 309, thereby spirally moving and extruding the filament 309 into a downward spread conical shape.

The spinning apparatus has a pair of diametrically opposite second air holes 311 for horizontally spraying air. The air holes 311 are disposed at opposite sides of the spinning nozzle 308 and below the first air holes 310-1 to 310-6. The second air holes 311 jet air streams in opposite directions parallel to the direction of movement of a screen mesh 312. As a result, the air streams strike directly below the spinning nozzle 308. The two air streams thus struck spirally move the filament 309, and the filament 309 is spread outward in a direction (transverse direction) perpendicular to the direction of movement of a web of a non-woven fabric 313. In this manner, the filament 309 is arranged on the screen mesh 312.

The oblique first air holes 310-1 to 310-6 of the spinneret extend tangentially to the spinning nozzle 308 as shown in FIG. 8 and also extend obliquely at an angle with respect to the central axis of the spinning nozzle 308 as shown in FIG. 9. With this arrangement, air blown-off from the respective air holes 310-1 to 310-6 substantially converge at a region spaced downwardly from the spinning nozzle 308 by a distance of several centimeters to ten centimeters or more. The streams of air thus converged cause the spiral movement of the filament 9 as described above. The filament 309 deposited on the screen mesh 312 is mainly arranged in the widthwise direction of the non-woven fabric 313. In this manner, the strength of the non-woven fabric 313 is enhanced especially in its widthwise direction.

Alternatively, the first air holes 310-1 to 310-6 may be arranged linearly in the vicinity of the spinning nozzle 308 on condition that air blown-off from the air holes 310-1 to 310-6 strikes the filament 309 to thereby cause the same to be spread to some extent before the filament 309 is widely spread by the air blown-off from the second air holes 311. The non-woven fabric 313 produced by the spinning apparatus with a single spinneret has a width of about 100 to 300 mm. A non-woven fabric having a width more than 300 mm can be produced by a spinning apparatus having a plurality of transversely arranged spinnerets. Furthermore, it is possible to produce a dense non-woven fabric at a high speed by utilizing a spinning apparatus in which a plurality of spinnerets are arranged in the lengthwise direction of the non-woven fabric.

If this spinning is melt spinning, the air blown-off from the first air holes 310-1 to 310-6 and the air blown-off from the second air holes 311 are heated at a temperature higher than the melting temperature of the polymeric material used for the formation of the filament 309. Heating of either one of the air supplied from the first air holes 310-1 to 310-6 and the air supplied from the second air holes 311 may be omitted depending on the kind of the polymeric material used. With the use of the hot air, the filament 309 while being formed does not undergo substantial molecular orientation.

The spinneret described above can be used for the formation of a non-woven fabric composed of un-oriented filaments arranged substantially in the lengthwise direction of the fabric. In this instance, the spinneret is turned about the central axis of the spinning nozzle 308 through an angle of 90° from the position shown in FIG. 8 to a position in which the second air holes 311 extend perpendicularly to the direction of movement of the non-woven fabric while being produced. The thus formed non-woven fabric has a strength in especially its lengthwise direction.

A method of means for vibrating a spun filament will be described in detail below.

A spun filament must be spirally turned or reciprocated (to be referred to as vibrated hereinafter for simplicity) in zigzag with an amplitude of several to several tens millimeters, and preferably, five to 50 millimeters at a period of several tens to several hundreds times/min., and preferably, 300 times/min. or more. In order to vibrate a filament, (1) a fluid is applied to a portion close to a spinning nozzle, (2) an electric or magnetic field is used, or (3) a spinning nozzle itself is vibrated.

According to the method of vibrating a spinning nozzle, vibration can be stably obtained regardless of the type or viscosity of polymer. In order to vibrate a spinning nozzle, the spinning nozzle may be circularly moved (although a circular motion is representatively described in the appended claims, this motion includes an elliptic motion) to spirally move a spun filament or linearly reciprocated. Since it is experimentally found that no vibration effect is obtained if the amplitude of vibration of a spinning nozzle is 1 m or less, the amplitude is preferably 5 mm or more. In addition, it is found that if the amplitude is as wide as 300 mm or more, the uniformity of scattering cannot be maintained. Therefore, the amplitude is preferably 50 mm or less. If the period of vibration is 60 times/min. or less, the productivity of a non-woven fabric is poor, and collection of scattered filaments is insufficient. In order to form a non-woven fabric, therefore, a spinning nozzle must be vibrated at a period of 300 times/min. or more. More preferably, the spinning nozzle is turned or reciprocated at a period of 30 times/sec. (1,800 times/min.) or more. When a spinning nozzle was turned or reciprocated at a period of 30 times/sec. or more, subsequent scattering was stable.

In order to vibrate a spinning nozzle, a high-speed alternating current may be applied to an electromagnet, the current may be turned on/off, or N and S poles may be converted by an electromagnet, thereby alternately applying its attraction and repulsion forces. In such an electromagnetic method, the amplitude is preferably increased by using a link or a lever. As a mechanical method, a method of circularly moving a nozzle eccentrically supported on a high-speed rotary disc, a method of converting a rotary motion into a linear motion by using a cam or a crank, and a method of amplifying a circular motion or giving an elliptic motion by using a cam or a link are available. Commercially available electric vibrators or air-driven vibrators can be used if their amplitudes are amplified.

If a polymer is dissolved in a solvent or dispersed in the form of an emulsion in a solution and is spun, a fluid for vibrating or scattering a filament need not be heated.

In addition, if a spinning nozzle itself is vibrated, a fluid for scattering a filament need not be heated. That is, as such a fluid, not only a heated gas but also a non-heated gas, a liquid or vapor, or a gas containing a liquid can be used. Furthermore, in order to increase the force of the fluid flows, a fine powder of a heavy or adhesive solid body may be mixed. These fluid flows may be a fluid for not only vibrating or scattering a filament but also assisting coagulation or adhesion of the filament.

As a method of vibrating a spun filament, the method of applying a fluid to a portion close to a spinning nozzle and the method of vibrating a spinning nozzle itself have been described. As another method, an electric or magnetic field may be used to change the polarity of the field, thereby giving vibration. For example, a high voltage is applied on a spun filament, and magnetic fields of N and S poles are alternately applied at a high speed to the charged filament, thereby vibrating the spun filament. In this method, a positive or negative electric field can be used. This method is suitably used especially when a plurality of filaments are to be spun from a spinning nozzle since the spun filaments are not united but separated well. The above various types of methods using air, vibration of a spinning nozzle, and an electric charge may be used in combination of two or more thereof.

A filament to be spun may be a single filament like a monofilament or a plurality of filaments like a multifilament. When a plurality of multifilament-like filaments are simultaneously vibrated and scattered, the productivity can be improved. Alternatively, a filament may be sprayed together with a gas from a spinning nozzle and the sprayed filament may be vibrated and scattered, as in a melt blowing method of a non-woven fabric.

FIGS. 11A to 11D are sectional views each showing a spinning nozzle for explaining a typical example of a method of vibrating a spun filament in step II shown in FIG. 7.

FIG. 11A shows a method of spraying a small fluid flow 331 (mostly air stream) from a portion close to a spinning nozzle 332 to cause vibration. A polymer 334 is spun from the spinning nozzle 332. As shown in FIG. 11A, a filament 335 is spirally vibrated by an action of the fluid flow jetted as indicated by an arrow 333. FIG. 12 shows various types of such a nozzle.

FIG. 11B shows a method of applying a magnetic field to vibrate a filament. A polymer 341 is spun from a spinning nozzle 342. The spun filament is charged by a high voltage E applied from an electrode 343. This filament is passed through a magnetic filed in which N and S poles are alternated at a high speed. This magnetic field is generated by supplying an alternating current from a power source 344 to electromagnets 345 and 346. As a result, a filament 347 is vibrated (moved) in zigzag. Alternatively, the filament can be spirally vibrated by rotating the magnetic field at a high speed.

The nozzle is fixed in each of FIGS. 11A and 11B.

Figure 11D:
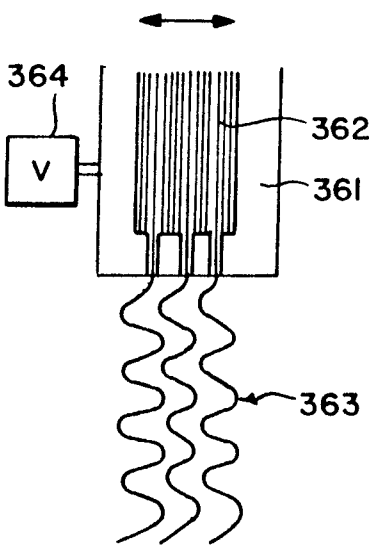
FIGS. 11A to 11D are side sectional views showing practical arrangements of a spinning nozzle for vibrating filaments.
Figure 11C:
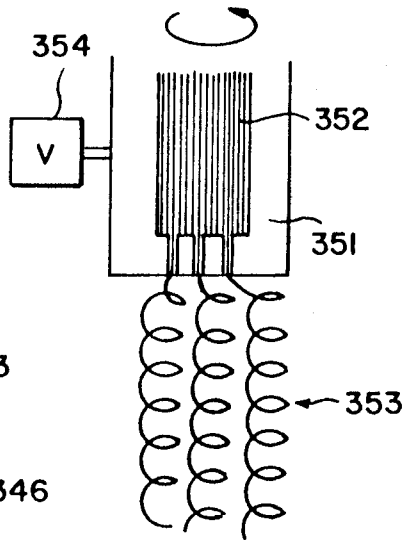
Figure 11B:
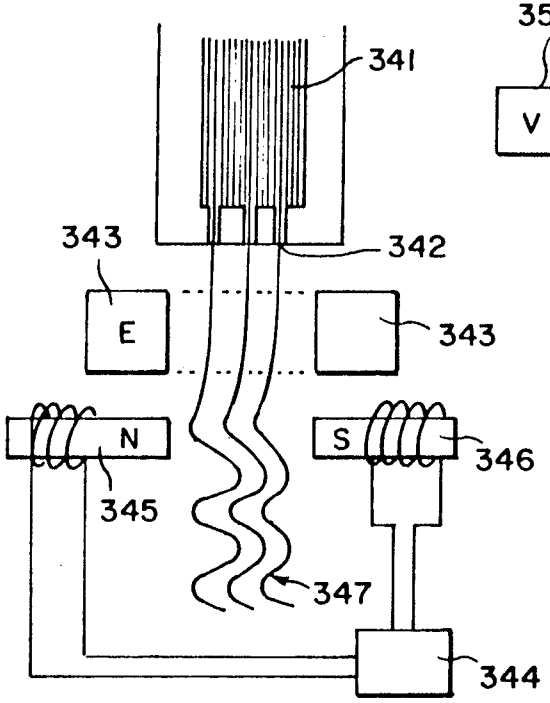
Figure 11A:
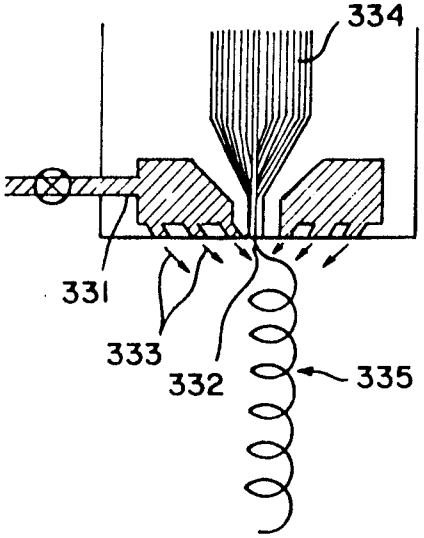

FIGS. 11C and 11D show methods of moving a nozzle by a vibration source V.

FIG. 11C shows a method of circularly moving a nozzle 351 to spirally vibrating a spun filament 353. Referring to FIG. 11C, reference numeral 352 denotes a polymer; and 354, a vibrating means. A means as shown in FIG. 15 or 16 (to be described later) can be used as the vibrating means 354.

FIG. 11D shows a method of linearly vibrating a nozzle 361 to vibrate a filament 363 in zigzag. Referring to FIG. 11D, reference numeral 362 denotes a polymer; and 364, a vibrating means. A means as shown in FIG. 15 or 16 can be used as the vibrating means 364.

A nozzle need not be circularly or linearly vibrated but can be elliptically or polygonally vibrated. Although each of the above drawings shows a method of linearly vibrating a filament spun from a spinning hole (spinning nozzle), a filament may be slightly coagulated while it still has drafting properties as shown in FIG. 4 and then subjected to the above processing.

FIGS. 12A to 12D show practical arrangements or jet holes for spraying small amounts of fluid flows for vibrating a spun filament. These drawings are bottom views in each of which a spinning nozzle is viewed from below. Referring to FIGS. 12A to 12D, reference numeral 435 denotes a lower plate of a spinning apparatus; and 436, a spinning nozzle.

Figure 12A:
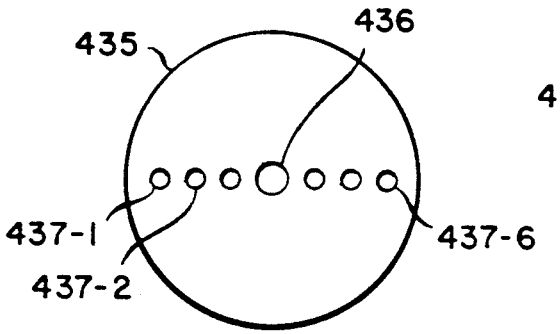
FIGS. 12A to 12D are bottom views of spinning nozzles showing arrangements of injection holes of small amounts of fluid for vibrating spun filaments.

FIG. 12A shows an arrangement in which fluid jet holes 437-1, 437-2, . . ., 437-6 are linearly arranged round the spinning nozzle 436.

Figure 12B:
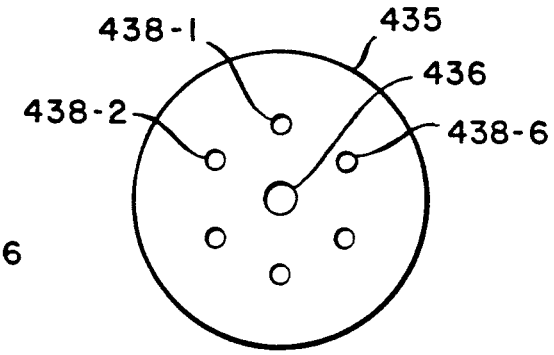

FIG. 12B shows an arrangement in which fluid jet holes 438-1, 438-2, . . ., 438-6 are circularly arranged around the spinning nozzle 436. This fluid may be a coagulating solution to be jetted together with a spinning solution from the spinning nozzle 436. In addition, the fluid jet holes are preferably opened with an angle with respect to the spinning direction of a filament.

Figure 12C:
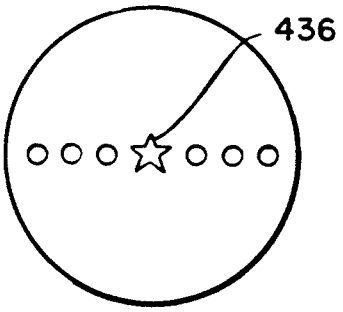
Figure 12D:
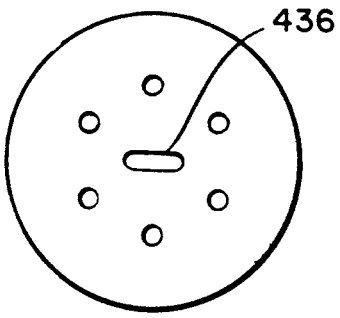

FIGS. 12C and 12D show arrangements in which the spinning nozzles 436 are not circular. That is, the spinning nozzle is star-shaped in FIG. 12C and elliptic in FIG. 12D.

A process of scattering and spreading a filament will be described below.

A vibrating filament to be spread is not completely coagulated. In a spreading process, twice or more of drafting properties preferably remain. A filament which is completely coagulated to lose its drafting properties cannot be sufficiently spread nor arranged well in the spreading process. When a filament has preferably 10 times or more, and more preferably, 100 times or more of drafting properties, the spreading width of the scattered filament is large and the degree and uniformity of its arrangement are good. When a solution-type spinning liquid (obtained by dissolving a polymer in a solvent or dispersed in the form of emulsion in a solution) is to be used, a filament may be passed through a coagulating bath immediately after it is spun and vibrated at an outlet of the coagulating bath. In this case, since the drafting properties are lost if coagulation is completely finished, the spreading step must be started while a filament has at least twice or more of drafting properties.

The cross-section of a filament may be formed into an elliptic or modified cross-section different from a true circle so as to easily receive the effect of a fluid. For this purpose, a spinning nozzle is preferably formed to have a rectangular, elliptic, or modified cross-section different from a true circle (e.g., as shown in FIGS. 12C and 12D). In this manner, when the cross-section of a filament is formed into a shape different offset from a true circle, the filament can be scattered to be spread and arranged well with even a small amount of a low-pressure fluid.

Two methods of forcing a fluid to scatter a vibrating filament will be described below. In one method, at least a pair of fluid flows substantially symmetrical about the center of a vibrating filament are continuously struck sideways against each other on the filament, thereby scattering the filament in a direction perpendicular to the jetting direction of the fluid flows. In the other method, at least a pair of fluid flows substantially symmetrical about the center of a filament are continuously crossed sideways each other within a vibration range of the filament, thereby scattering the filament in a direction substantially parallel to the jetting direction of the fluid flows.

Note that in the method disclosed in Japanese Patent Laid-Open No. Sho 45-10779, the line speed cannot be increased beause right and left fluid flows are alternately, intermittently jetted. In the present invention, however, the line sped can be increased since the fluid flows are continuously jetted. In these two methods, generating sources of the fluid flows to be scattered need not be one pair but may be two or three pairs with respect to one spinning nozzle to increase the efficiency.

Figure 13A:
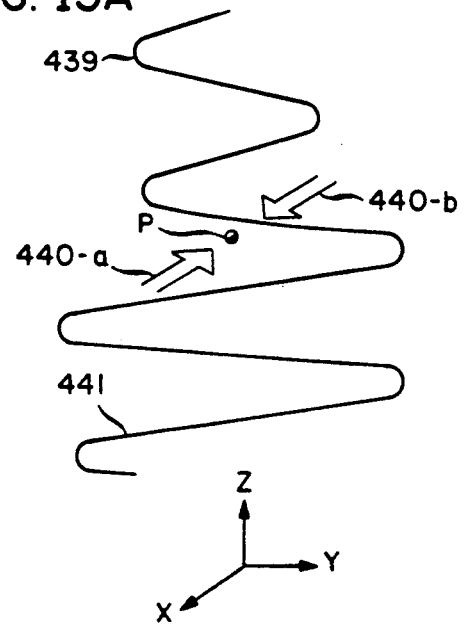
FIGS. 13A and 13B are schematic views showing the manner of forcing high-pressure fluid flows on vibrating filaments to scatter and spread the filaments.
Figure 13B:
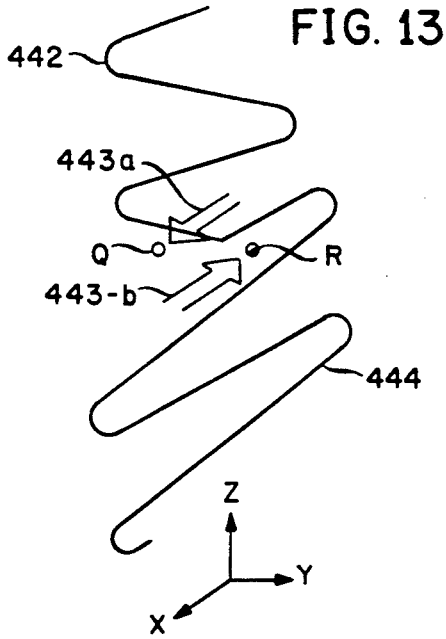

FIGS. 13A and 13B show methods of forcing high-pressure fluid flows for scattering and spreading a vibrating filament in step III shown in FIG. 7.

Referring to FIG. 13A, a filament 439 moves parallel to the Y axis while vibrating in zigzag, and fluid flows are applied on the filament in a direction (X direction) perpendicular to the vibration direction (vibration plane). A pair of symmetrically sprayed fluid streams 440*a* and 440*b* are struck against each other at a position P shown in FIG. 13A. When the struck fluid flows are scattered in the Y direction, the filament is scattered sideways in the Y direction together with the fluid flows, thereby forming a filament group 441 arranged parallel to the Y axis.

Referring to FIG. 13B, a pair of sprayed fluid streams 443*a* and 443*b* are jetted against a filament 442 vibrating in zigzag parallel to the Y axis. Unlike in the method shown in FIG. 13A, the sprayed streams 443*a* and 443*b* are not struck against each other but crossed (passed by) each other at different points Q and R on the vibrating filament. Therefore, a fluid flow striking against the filament can move forward without being much disturbed by the other fluid flow sprayed from a symmetrical position. The filament is scattered by the fluid flows to form a filament group 444 which is arranged and scattered in substantially the X direction.

In each of FIGS. 13A and 13B, the filament can be arranged in any direction in accordance with a relative positional relationship between the moving direction of a conveyor disposed below to collect the filament or a non-woven fabric and a direction of forcing the scattering fluid. Although the filaments 439 and 442 are vibrated in the transverse direction in FIGS. 13A and 13B, they may be moved while being spirally turned.

In many cases, a non-woven fabric according to the present invention is preferably stretched (or rolled) in the arranging direction of a filament. Conventional methods can be used as the stretching (or rolling) method. Since the non-woven fabric according to the present invention has good thickness uniformity and a high degree of orientation of a filament and hardly produces a grain or mass, it is suitable for especially stretching. In addition, a cross-laminated non-woven fabric can be made by laminating a non-woven fabric made in accordance with the present invention and a non-woven fabric arranged in a direction substantially perpendicular to the arranging direction of the non-woven fabric according to the present invention and biaxially stretching the laminated non-woven fabric in the arranging directions of the filaments of the both. In this case, biaxial stretching may be either sequential or simultaneous biaxial stretching. In addition, regardless of whether uniaxial or biaxial stretching is to be performed, the strength can be effectively increased by stretching when a non-woven fabric is slightly adhered or bonded before it is stretched. In order to produce a strong non-woven fabric, filaments are preferably bonded by adhesion or mechanical bonding after stretching.

Although the non-woven fabric according to the present invention can be singly used as a product, it is generally used as a cross-laminated non-woven fabric in which it is united with a non-woven fabric or a fiber material web (e.g., a web in which yarns or stretching tapes are arranged at predetermined intervals (pitches), a web obtained by widening (spreading) a tow, or a carded web of spinning) arranged in a direction perpendicular to its arranging direction.

A uniting process can be performed in either a non-woven fabric manufacture line or another line. Non-woven fabrics composed of similarly produced materials and arranged in the longitudinal and transverse directions by changing the jetting direction of fluid flows may be united. In addition, obliquely arranged non-woven fabrics may be united so that their arranging directions are crossed each other. In this case, the non-woven fabrics may be crossed not only at an angle of exactly 90° but also at an angle of 30° to 150°. A longitudinally or transversely arranged material may be united with an obliquely arranged material to form a triaxial or tetraaxial non-woven fabric.

In addition, not only materials similarly produced but arranged in different directions but also entirely different materials or materials similar to each other but produced by entirely different processes may be united. A material to be united is preferably arranged in a direction perpendicular to the arranging direction of filaments of a non-woven fabric of the present invention in order to obtain a good balance in physical properties. United materials may be bonded by using an adhesive in the form of a powder or emulsion or performing mechanical bonding such as needle punching.

Since the non-woven fabric of the present invention has a very fine denier, if fabrics are united in a non-woven fabric manufacture line, they can be bonded by interengagements between fine filaments without using any adhesive.

In addition, in the manufacture of the non-woven fabric of the present invention, filaments having adhesion properties can be spun from a large number of spinning nozzles so that an adhesive is contained in the non-woven fabric itself. In this case, the obtained non-woven fabric can be bonded to another material by only heating. If adhesion between sheet-like filaments can be improved upon application of a pressure on the filaments, the bonding strength between fibers can be effectively increased by using an embossing roll or the like. Furthermore, when a solution-type spinning liquid is used, if filaments are not completely coagulated and therefore still have self-adhesion properties after they are scattered and collected as unidirectionally arranged filaments, they are adhered to each other by utilizing the adhesion properties.

According to the method of the present invention, filaments can be arranged in the transverse direction, and an arrangement of yarns running in the longitudinal direction can be fixed by the transversely arranged filaments. In this case, the filaments are preferably composed of an adhesive polymer. A web in which an arrangement of running yarns is fixed as described above can be used as a weft web of a cross-laminating machine as disclosed in Japanese Patent Publication No. Sho. 53-38783.

Examples of the material of a non-woven fabric according to the present invention are a polyolefin such as HDPE or PP, a thermoplastic polymer such as a polyester, a polyamide, polyvinyl chloride, polyacrylonitrile, polyvinylalcohol, or polyurethane, glass, a pitch, an adhesive polymer, solutions obtained by dissolving these materials in a solvent, and emulsions obtained by dispersing these materials together with a surface active agent in a dispersion. In addition, a material obtained by dissolving a cellulose-based polymer which is difficult to be melt-spun in a solvent can be particularly effectively used. What is important in these polymers is that filaments made from the polymers still have thread-forming property upon stretching and scattering and can be drafted several tens times to several thousands times.

Figure 14A:
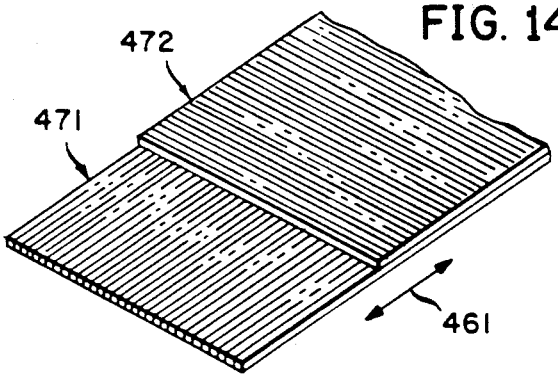
FIGS. 14A to 14C are schematic perspective views showing practical arrangements of filaments of a non-woven fabric obtained by cross-laminating unidirectional non-woven fabrics.
Figure 14B:
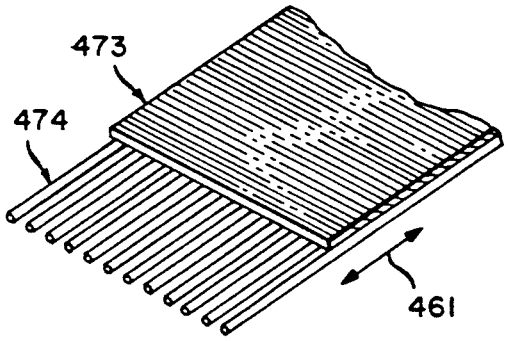
Figure 14C:
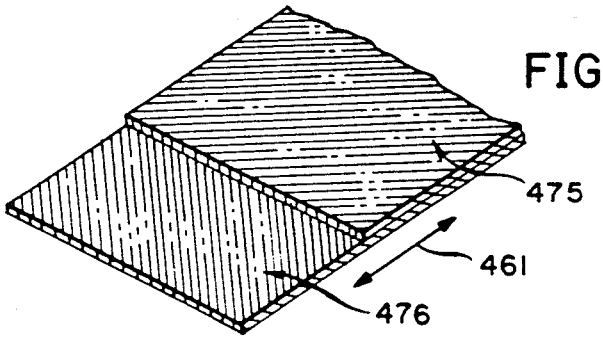

FIGS. 14A to 14C show practical arrangements of filaments of cross-laminated non-woven fabrics produced by cross-laminating unidirectionally arranged non-woven fabrics in step VI shown in FIG. 7. Referring to FIGS. 14A to 14C, the direction indicated by an arrow 461 is the longitudinal direction, and the filaments are arranged and oriented in the direction of hatching. For better understanding of the structure, an upper layer is partially removed.

Figure 17:
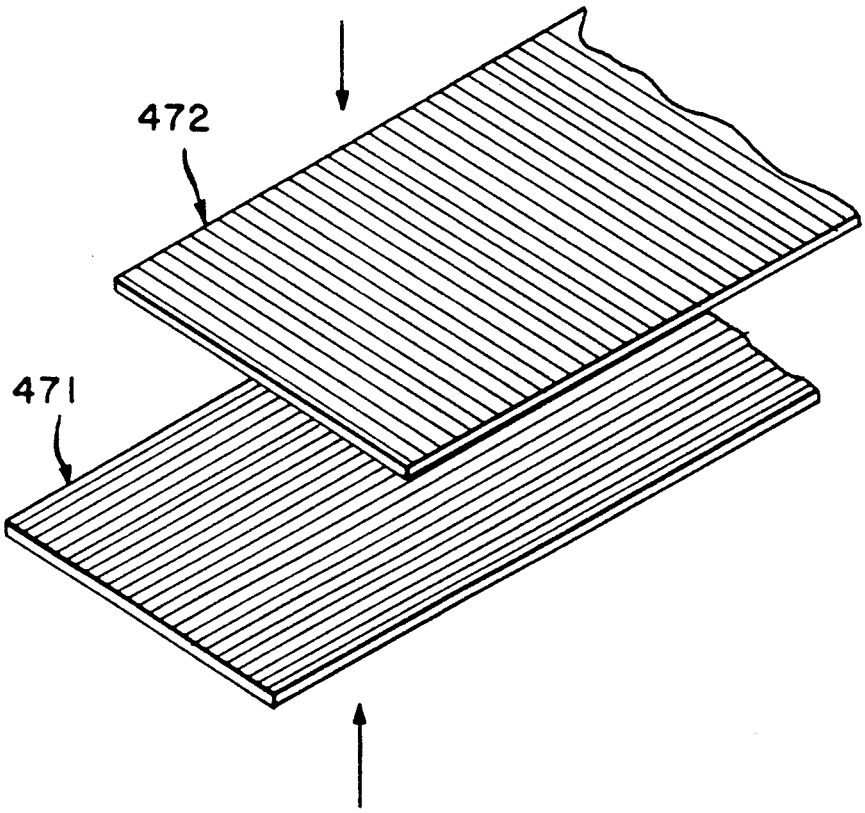
FIG. 17 is a schematic perspective view showing the manner of laminating non-woven fabric having strength in the longitudinal direction and a non-woven fabric having strength in the transverse direction.

FIG. 14A shows an arrangement of a longitudinally arranged filament layer 471 and a transversely arranged filament layer 472. The filaments in both the directions are arranged by the method of the present invention. FIG. 17 shows the structure of laminating. Referring to FIG. 17, the filament layer 471 having strength in the longitudinal direction and the filament layer 472 having strength in the transverse direction are laminated.

FIG. 14B shows a structure in which a transversely arranged filament 473 according to the method of the present invention is laminated on a layer 474 in which conventional yarns are arranged in the longitudinal direction at a predetermined pitch. Although not shown in FIG. 14B, another yarn layer may be laminated on this structure.

FIG. 14C shows a structure in which an obliquely arranged filament layer 475 according to the present invention is laminated on a layer 476 in which filaments are arranged in another oblique direction perpendicular to the oblique direction of the layer 475. When filaments are obliquely arranged as shown in FIG. 14C, another non-woven fabric or fiber web in which filaments are arranged in the longitudinal or transverse direction can be laminated thereon to form a triaxial or tetraaxial non-woven fabric.

Figure 15A:
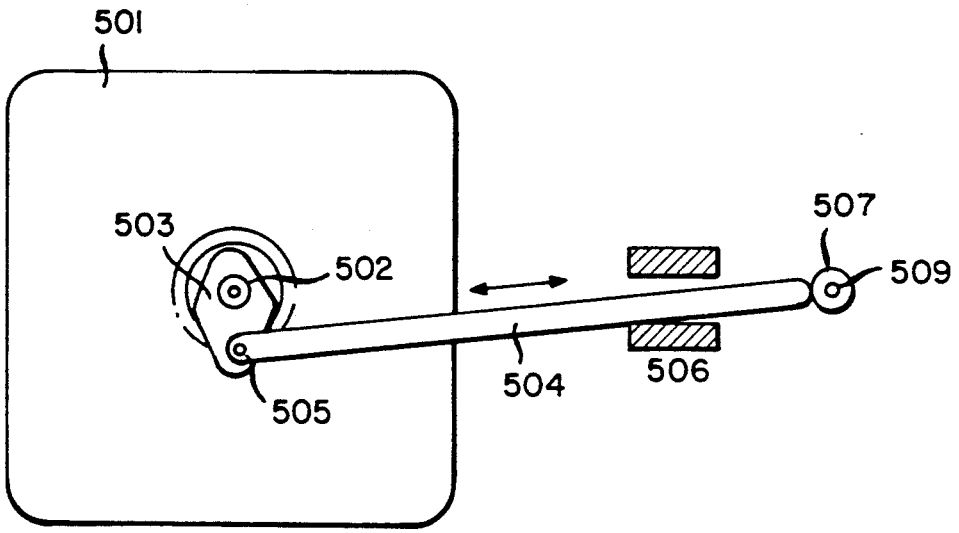
FIGS. 15A and 15B are plane and side views showing a practical arrangement of a mechanism for vibrating a nozzle.
Figure 15B:
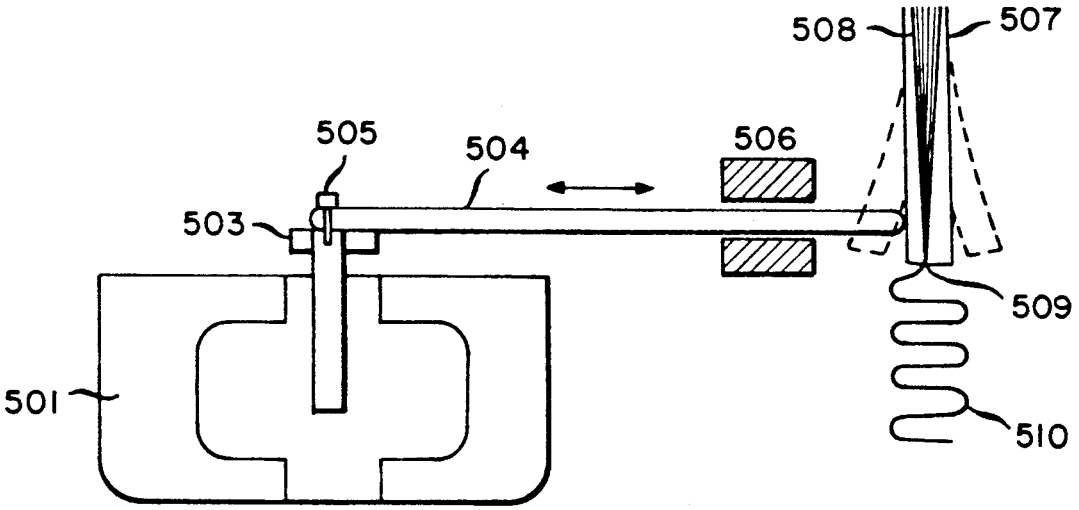

FIG. 15 shows a practical arrangement of a vibrating means, in which FIG. 15A is a plane view and FIG. 15B is a side view. Referring to FIGS. 15A and 15B, a high-speed motor 501 rotates a crank arm 503 disposed on a rotary shaft 502. The crank 503 circularly moves a pin 505 disposed thereon as indicated by an alternate long and short dashed line shown in FIG. 15A. One end of a connecting rod 504 is so set as to allow the crank to freely rotate by the pin 505. The other end of the connecting rod 504 is fixed to a flexible nozzle 507 through a wall 506. Upon rotation of the motor shaft 502, the connecting rod 504 is reciprocated to vibrate the nozzle 507 as indicated by an arrow 511 shown in FIGS. 15A and 15B. A melted or dissolved polymer 508 is injected from a spinning nozzle 509 at the distal end of the nozzle 507. An injected filament 510 is vibrated by vibration of the nozzle 507.

Although linear vibration is exemplified in the above arrangement, the crank can be moved about the guide wall 506 to circularly or elliptically move the nozzle 507.

Figure 16A:
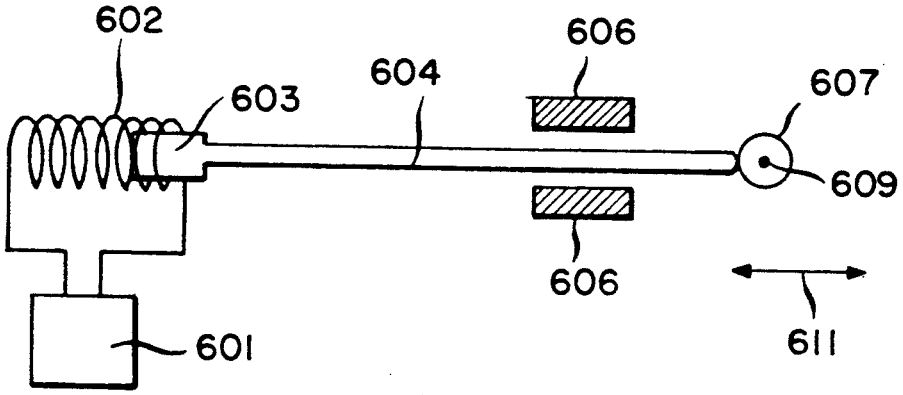
FIGS. 16A and 16B are plane and side views showing a practical arrangement of a mechanism for electromagnetically vibrating a nozzle.
Figure 16B:
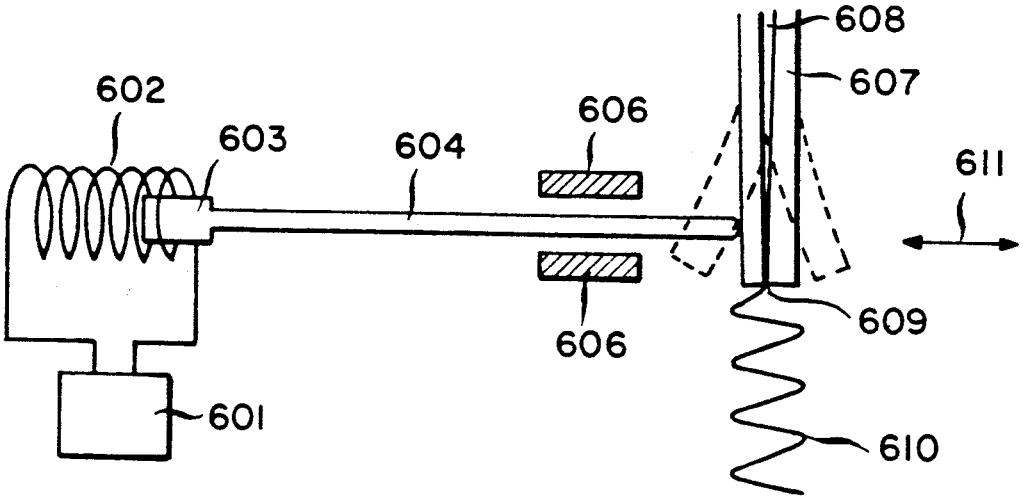

FIG. 16 shows another practical arrangement of a vibrating means, in which FIG. 16A is a plan view and FIG. 16B is a side view. Referring to FIGS. 16A and 16B, a power source 601 supplies an alternating current to a solenoid 602. A connecting rod 604 is supported by a support wall 606, and a movable iron core (vibrating member 603 is disposed at one end of the connecting rod 604. The other end of the connecting rod 604 is fixed to a flexible nozzle 607 through the support wall 606. When an alternating current is supplied to the solenoid 602, an alternating magnetic field is generated to reciprocate the movable iron core 603. As a result, the connecting rod 604 is reciprocated to vibrate the nozzle 607 as indicated by an arrow 611 shown in FIGS. 16A and 16B. A melted or dissolved polymer 608 is injected from a spinning nozzle 609 at the distal end of the nozzle 607. An injected filament 610 is vibrated by vibration of the nozzle 607.

Examples of a non-woven fabric according to the present invention made by using a manufacturing method (or a manufacturing apparatus) of the present invention will be described in detail below.

EXAMPLE 1

A polyethyleneterephthalate pellet having a limit viscosity $\eta$ of 0.72 was melted and extruded at 260° C. by an extruder and guided to a spinning nozzle through a flexible conduit by the method shown in FIG. 2. The spinning nozzle was circularly moved at a period of 2,400 times/min. for a width of 35 mm. A spun filament was spirally moved downward at the same period as that of the spinning nozzle for a width of 22 mm. A pair of air streams heated up to 300° C. were sprayed in the Y direction shown in FIG. 1 from positions substantially symmetrical about the center of the spirally moving filament so as to be crossed each other as shown in FIG. 13B.

By a scattering force of the crossed air streams, the filament was arranged in the transverse direction with respect to the direction of movement of a conveyor belt arranged in the Y direction and having a width of about 350 mm and was collected on the conveyor belt moving below at a speed of 40 m/min. The filament was coated with an acrylic emulsion adhesive on the conveyor belt and guided to a pulley-like transverse stretching means.

The pulley diameter of the transverse stretching means was 1,200 mm. A hot wind at a temperature of 180° C. was circulated for heating, and the filament was stretched by 2.8 times in the transverse direction after the adhesive was dried in a preheating process. A non-woven fabric manufactured by a conventional non-woven fabric manufacturing apparatus and stretched by 3.2 times in the longitudinal direction was laminated on the above transversely stretched non-woven fabric. An acrylic emulsion adhesive was impregnated in the resultant non-woven fabric and cylinder-dried, thereby obtaining a cross-laminated non-woven fabric having a width of about 1,000 mm.

The produced non-woven fabric had a unit weight of 35 g/m$^2$, a strength of 27.2 kg/width of 5 cm and a stretching ratio of 22% in the longitudinal direction, and a strength of 24.1 kg/width of 5 cm width and a stretching ratio of 25% in the transverse direction. That is, this non-woven fabric had a strength in both the longitudinal and transverse directions, and the strength was three to four times as greater as that of a conventional polyester random-laid non-woven fabric.

EXAMPLE 2

A cuprammonium solution (concentration=8%) of a linter pulp was used to make a non-woven fabric as shown in FIG. 4. This solution was spun from a spinning nozzle and flowed together with water to a funnel. As a result, the resultant material was slightly coagulated and stretched. While drafting properties of 20 times or more were left, the distal end of an outlet of the funnel was horizontally vibrated with an amplitude of about 10 mm at a period of 600 times/min. An obtained filament was vibrated with an amplitude of 30 mm by a force of the water, and a pair of water streams were vertically sprayed (by the method shown in FIG. 13A) to strike against the filament. The filament was arranged in the transverse direction by a force of the transversely scattering water and collected on a moving conveyor belt.

The collected filament was not completely coagulated yet. This filament was laminated on a cellulose non-woven fabric (arranged in the longitudinal direction) produced in a previous step by a conventional cuprammonium process and conveyed by a conveyor, and the laminated non-woven fabrics were simultaneously acid-treated to form a non-woven fabric having dimensional stability in both the longitudinal and transverse directions. In this case, since coagulation was not completed when the longitudinally and transversely arranged non-woven fabrics were laminated, the filaments themselves had an adhesive force, and no adhesion processing need be performed.

EXAMPLE 3

A 15% decalin solution of high-density polyethylene was spun from the nozzle shown in FIG. 11B to obtain longitudinally arranged filaments by the method shown in FIG. 13B. In this case, a room-temperature air particularly not heated was used together with the air for vibration shown in FIG. 12B and the air for scattering shown in FIG. 13B.

The obtained non-woven fabric was composed of very fine filaments (mostly much smaller than one denier) and had good adhesion properties between the filaments without performing adhesion processing. This non-woven fabric was subjected to proximity roller stretching by five times in the longitudinal direction to produce a non-woven fabric having a unit weight of 15 g/m$^2$, a longitudinal strength of 17.4 kg/5 cm, and a longitudinal stretching ratio of 27%. That is, the obtained non-woven fabric was strong in the longitudinal direction. This non-woven fabric had optimal properties as a material web of a cross-laminated non-woven fabric.

INDUSTRIAL APPLICABILITY

A non-woven fabric according to the present invention has a high tensile strength and therefore can be suitably used as, e.g., geo-textiles (fiber materials for the civil engineering and construction).

We claim:

1. A method of making a non-woven fabric comprising the steps of:

spinning a filament composed of polymeric material;

vibrating said filament;

amplifying the vibration of said filament in a predetermined first axis direction whereby the filament is scattered, the scattered filament depicting an ellipse having a elongated major axis as a locus in its cross section every one cycle of the vibration, the direction of the major axis corresponding to the first axis; the amplifying step being started at a point other than the starting point of the filament vibration step; and collecting the scattered filaments into a series of ellipses so that the major axis of each ellipse deviates from the immediately adjacent ellipse in a predetermined second axis direction crossing the first axis and the major axes of said ellipses are arranged substantially in parallel.

2. A method of making a non-woven fabric comprising the steps of:

spinning a filament composed of a polymeric material;

vibrating said filament;

amplifying the vibration of said filament;

collecting said filament into an elliptic shape having an elongated major axis and arranging said filament in the direction of substantially the major axis, wherein said filament vibration amplifying step comprises continuously striking a pair of fluid flows jetting in directions opposite to one another on the substantial center of vibration of the vibrating filament to direct the fluid flows in a direction perpendicular to the jetting direction of the fluid flows, such that the amplitude of the vibrating filament is amplified in said perpendicular direction and wherein in said filament vibration amplifying step, the amplification of vibration of the vibrating filament starts at a point other than the starting point of the filament vibration in the step of vibrating the filament and said filament vibration amplifying step comprises discontinously amplifying the amplitude of the vibrating element.

3. A method of making a non-woven fabric according to claim 2, wherein said filament spinning step comprises spinning said filament by using a solution prepared by dissolving a polymeric material in a solvent, a solution prepared by dispersing a polymeric material in the form of emulsion in a medium, or a melted polymeric material.

4. A method of making a non-woven fabric according to claim 2, wherein said filament spinning step includes the step of passing said filament through a coagulating bath immediately after said filament is spun, and said filament vibrating step comprises vibrating said filament at an outlet of said coagulating bath.

5. A method of making a non-woven fabric according to claim 2, wherein said filament vibrating step comprises vibrating said filament in zigzag.

6. A method of making a non-woven fabric according to claim 2, wherein said filament vibration amplifying step comprises amplifying vibration of said filament while said vibrating filament still has draft properties of less than twice.

7. A method of making a non-woven fabric according to claim 2, wherein said filament amplifying step comprises continuously applying sideways not less than one pair of fluid flows substantially symmetrical about said vibrating filament, thereby amplifying vibration of said filament.

8. A method of making a non-woven fabric according to claim 2, wherein said filament vibration amplifying step comprises amplifying vibration of said spun filament while said filament vibrates with an amplitude of 1 to 300 mm at a period of not less than 60 times/min.

9. A method of making a non-woven fabric according to claim 8, wherein said filament vibration amplifying step comprises amplifying vibration of said spun filament while said filament vibrates with an amplitude of 5 to 50 mm at a period of not less than 300 times/min.

10. A method of making a non-woven fabric according to claim 2, wherein said filament spinning step comprises spinning said filament having an elliptic or modified cross-section different from a true circle.

11. A method of making a non-woven fabric according to claim 2, further comprising the step of stretching said filament in the arranging direction of said filament after said filament arranging step.

12. A method of making a non-woven fabric according to claim 2, further comprising the step of laminating another base material.

13. The method of making a non-woven fabric according to claim 2, further comprising the step of arranging the vibrated and amplified filament in a sheet.

14. A method of making a non-woven fabric according to claim 2, wherein the step of spinning comprises a step of spinning a first filament and a step of spinning a second filament, the step of vibrating comprises a step of vibrating the first filament and a step of vibrating the second filament, the step of amplifying comprises a step of amplifying the vibration of the first filament and a step of amplifying the vibration of the second filament, and the step of collecting comprises a step of collecting the amplified first filament into a first ellipse having an elongated major axis and arranging the first filament in a first direction substantially the same as the direction of the major axis to form a first non-woven fabric and a step of collecting the amplified second filament into a second ellipse having an elongated major axis in a direction substantially perpendicular to the first direction and arranging the second filament in a second direction substantially the same as the direction of the major axis of the second ellipse to form a second non-woven fabric.

15. The method of making a non-woven fabric according to claim 14, wherein the first and second non-woven fabrics are laminated together.

16. A method of making a non-woven fabric comprising the steps of:

spinning a filament composed of polymeric material;

vibrating said filament;

amplifying the vibration of said filament;

collecting said filament into an elliptic shape having an elongated major axis and arranging said filament in the direction of substantially the major axis, wherein said filament vibration amplifying step comprises continuously crossing a pair of fluid flows jetting in directions opposite to each other within a vibration range of said filament without striking the fluid flows whereby the vibrating filament is blown away in the direction of one of the fluid flows when the filament crosses one of the fluid flows and the vibrating filament is blown away in the direction of the other fluid flow when the filament crosses the other fluid flow, whereby the direction of vibration of said filament is directed in the direction parallel to the jetting direction of the fluid flows and the vibration is amplified and wherein in said filament vibration amplifying step, the amplification of vibration of the vibrating filament starts at a point other than the filament vibration starting point of the step of vibrating the filament, said filament vibration amplifying step comprises discontinously amplifying the amplitude of the vibrating filament.

17. A method of making a non-woven fabric comprising the steps of:

spinning a filament composed of a polymeric material;

vibrating said filament;

amplifying the vibration of said filament, the amplifying step being started at a point other than the starting point of the filament vibration step;

collecting said filament into an elliptic shape having an elongated major axis and arranging said filament in the direction of substantially the major axis, wherein said filament vibration amplifying step comprises continuously striking a pair of fluid flows on the substantial center of vibration of the vibrating filament to direct the fluid flows in a direction perpendicular to a jetting direction of the fluid flows, whereby the amplitude of the vibrating filament is amplified in the perpendicular direction.

* * * * *